United States Patent [19]

Miceli

[11] Patent Number: 4,874,149

[45] Date of Patent: Oct. 17, 1989

[54] POST SUPPORT

[75] Inventor: Daniel Miceli, Bristol, Conn.

[73] Assignee: The Gordon Corporation, Southington, Conn.

[21] Appl. No.: 244,951

[22] Filed: Sep. 15, 1988

[51] Int. Cl.[4] ..... F16M 13/00

[52] U.S. Cl. ..... 248/530; 248/156; 248/545; 52/165

[58] Field of Search ..... 248/545, 533, 530, 532, 248/156, 85, 310, 508, 74.4; 52/155, 165

[56] References Cited

U.S. PATENT DOCUMENTS

| | | | |
|---|---|---|---|
| D. 29,550 | 10/1898 | Patterson | 52/165 X |
| 1,155,589 | 10/1915 | McDonald | 248/530 X |
| 1,438,074 | 12/1922 | Welch | 52/165 |
| 1,597,573 | 8/1926 | Blue | 248/156 X |
| 4,483,506 | 11/1984 | Litwiller | 248/156 X |
| 4,588,157 | 5/1986 | Mills | 248/545 |
| 4,644,713 | 2/1987 | Lehman | 52/165 |

FOREIGN PATENT DOCUMENTS

| | | | |
|---|---|---|---|
| 812529 | 5/1937 | France | 248/74.4 |

*Primary Examiner*—Ramon S. Britts
*Assistant Examiner*—Karen J. Chotkowski
*Attorney, Agent, or Firm*—Richard P. Crowley

[57] ABSTRACT

A post support for securing a post in the ground in a generally vertical position, which post support comprises an elongated ground-engaging spike to be driven vertically into the ground and a post support hollow container which comprises a pair of fixed, right angle vertical wall sections which form a part of the hollow container and which have tapered hemmed edges and a pair of right angled wedge end caps which also have tapered hemmed edges, with the wedge end caps adapted to have their edges fit in an overlapping relationship with the hemmed edges of the fixed vertical wall section and to be driven downwardly on the installation of the post to force the fixed wall sections inwardly so as to wedge and engage the post within the hollow container section thereby providing the support and securing of a post in the post support.

24 Claims, 2 Drawing Sheets

POST SUPPORT

BACKGROUND OF THE INVENTION

There are a wide variety of post support devices available to provide support and to secure posts, such as fence posts, mail box posts, sign posts and the like and other post-like elements, in a generally vertical, secure position in the ground. Generally, such post support devices include a hollow upper section to receive a post to be secured and supported and optionally an elongated, ground-engaging element to be driven or inserted into the ground and means to then secure the post in the hollow section from any movement in a secure, vertical, upright position. Often such post support devices require special or other tools for installation or require the use of separate supporting pins or other devices, such as flanges, to secure the post.

One post support for example is disclosed in U.S. Pat. No. 3,809,346, issued May 7, 1974 wherein a hollow socket is supported on a flat base plate and which hollow socket is adapted to receive a post to be supported and wherein pins are driven through the slots in the socket and into the ground in order to secure the post in position.

Another post support device is set forth in U.S. Pat. No. 4,588,157, issued May 13, 1986. This post support device includes an elongated, ground-engaging, cruciform spike portion which is driven vertically into the ground and an upper post-engaging portion in the form of a hollow box section for receiving one end of a post to be supported in a vertical position, and with the post axis substantially aligned with the axis of the ground-engaging portion. The hollow box section to receive the post has projections extending inwardly from the vertical wall of the box section so as to permit such vertical projections to be driven into and cut into the posts as the post is being driven into the box section thereby to secure the post within its hollow box section. Such post support devices require formation of such vertical inwardly projecting sections by bending a section of the wall inwardly.

It is desirable to provide a new and improved post support and method of supporting a post in which no special or other tools are required and no pins are required and which post support can adjust to various types of posts and which can be easily readjusted, and which generally provides peripheral pinching or pressure about the circumference of the post in the post support device.

SUMMARY OF THE INVENTION

This invention relates to a post support device and to a method of supporting and securing a post in a generally vertical position. In particular, the invention relates to a post support wherein a pair of fixed vertical wall sections forming a substantial part of a hollow, post-receiving section are forced inwardly into a pinching, securing relationship with the post within the hollow section by the use of slidable wedge means which when driven downwardly, the fixed wall sections are forced inwardly to secure the post in position.

A post support has been discovered for the securing in a rapid and efficient manner a post into the ground in a generally vertical position without the need for special tools. The post support comprises an elongated, ground-engaging element, such as, but not limited to: a cruciform-type, elongated spike or spike-type form, which is to be driven vertically into the ground, and a post support container section secured to and on top of the elongated, ground-engaging means and which post support container section forms a hollow post receiving section in either a rectangular, square or round or other shape to receive and support a post therein in a generally vertical position and substantially axially aligned with the ground engaging element.

The post container section includes at least one and generally a plurality, typically a pair of upright, generally vertical wall sections which form part typically a substantial part of the upright wall periphery of the hollow post container section and which are secured to the ground-engaging element. The fixed vertical wall sections have tapered, folded hems at each upright wall edge thereof adapted to slidably receive a wedge cap. The folded hem defines a slight open hem space, and the outer edge of the vertical wall section is slightly tapered in a straight line manner, such as but not limited to 0.5° to 10°, e.g. 1° to 3°, from the vertical axis of the post support, from the top to the bottom so that the horizontal edge width at the top of the fixed wall section is slightly greater than the horizontal width of the bottom of the fixed wall section. A smaller angle of taper (i.e., a more gradual angle of taper) is preferred since the degree of wedging will be greater. This angle of taper of the vertical wall and the wedge means should be substantially the same and typically 1° to 3° for a better wedge effect. The fixed wall sections are formed for example as right angle elements where a square or rectangular post is used or as an arcuate curved section where a round post is to be secured.

The post support also includes at least one and generally a plurality such as a pair of separate, wedge elements which in conjunction with the vertical wall sections form part of and the rest of the hollow post container section of the post support.

The wedge elements have a tapered, folded hem at each upright wall edge and are adapted to slidably fit over the folded hem of the wall section. The wedge elements are at each edge to define an open space with each of the outer edges tapered. Each of the outer edges of the wedge elements and the vertical wall sections are tapered substantially at the same tapering angle. The wedge elements form a right angle when employed with rectangular or square posts and complete the hollow box section about the post. The wedge elements are adapted to fit in a mating, slidable, securing, pinching relationship with the folded hems of each wall section and engage in an overlapping fitting relationship with the folded hem of the fixed vertical wall sections. After the post has been installed within the fixed wall sections of the folded hems of the wedge elements are fitted over the folded hems of the wall section and are driven downwardly by the use of a hammer. When driven downwardly, the overlapping edge of the wedge element forces inwardly the fixed vertical wall sections so that the fixed vertical wall sections then pinch in a securing relationship the post within the fixed vertical wall sections to provide a pressure about the post within the fixed vertical wall sections. The post support may be adapted to the securing and support of posts of a wide variety of diameters and may also be readjusted where the post secured later shrinks or changes dimension by hammering the wedge element downwardly further into a new wedging or pinching position.

The wedge elements employed may vary in form and design, so long as the wedge element is in an end pinching or wedging relationship with the outer vertical edges of the fixed vertical wall sections so as to force the outer end edges of the fixed wall section inwardly to secure the post within the fixed wall sections. In one preferred embodiment to be illustrated, the wedge elements form right angle wedge end caps with right angled, fixed, vertical wall sections and on being driven downwardly, pinch the fixed wall section inwardly to grip the post within the fixed wall section generally along a substantial part of the vertical height of the fixed wall section. The use of the wedge end cap is also advantageous in permitting the post support to be used with part of the varying post diameter.

The wedge elements with square or rectangular parts are generally used in pairs as end caps to form the two edges of the hollow section with the fixed vertical wall section which forms the other two edges. The wedge end caps are designed to be driven downwardly a substantial downward distance into a pinching relationship and generally and preferably are designed to pinch and secure a post, such as a 4"×4" post, in a secure manner when the wedge end caps are hammered to a flush top edge relationship with the top edge of the fixed wall section although the position of the wedge element may vary depending upon the design and degree of the wedge element may vary depending upon the design and degree of wedging desired.

Optionally, the wedge element may form a right angle or be arcuate in shape usually depending on the post, and further may contain one or more holes therein generally at the upper end for the insertion and hammering into the secured post of a nail to retain the wedge element in position.

Also, optionally the post support device may contain a drive plate sheet secured therein to or unsecured on the top of the ground-engaging portion. The drive plate is typically a flat metal plate which may be welded to the top of the ground-engaging portion and whose edges may be spaced apart from the vertical walls of the vertical hollow section which receives the post. The drive plate permits a short section of post to be inserted within the fixed vertical wall sections, then the post hammered to drive the ground-engaging portion of the post support into the ground. If the drive plate is not used, then the short section of post used to drive the ground-engaging section into the ground may become impaled on the top of the cruciform of the ground-engaging portion. Of course, if the post can easily be removed from the top of the cruciform form or if the post section is constantly turned during hammering, then a secure or unsecured drive plate may not be required.

The ground-engaging means is generally an elongated member to be driven into the ground and of sufficient strength and length to secure the post in the upright position. One form of a ground-engaging element comprises a tapered cruciform, but other forms and shapes may be used, such as a screw or spike. The sides of the ground-engaging element, such as the cruciform, may be smooth or optionally may contain outwardly projecting protrusions or tabs therein which will make the removal of the post support difficult, but which does not hamper the driving of the ground engaging portion into the ground. Where the ground-engaging element is smooth or straight sided, the element may be more easily removed for reuse. The outwardly extending tabs from one or more of the cross sections, typically the cross edge sections generally are cut or punched out of the cruciform edge cross sections and extending outwardly from the cross sections to permit the ground-engaging element to be driven into the ground easily in a vertical position, but difficult to remove since the tabs or wedges will resist removal by wedging into the ground, i.e. the tabs or wedges extend outwardly away from the vertical axis of the ground-engaging element at an outward angle to the downward direction. Typically the tabs are bent outwardly at an angle of less than 90° and in opposite directions on opposite sections of the cruciform element.

In use, the ground-engaging, spike-like section of the post support is hammered into the ground by employing a short section of post on top of the drive plate and in the hollow section, then the post support driven into the ground with firm blows from a sledgehammer with the post support checked periodically for vertical orientation, such as for example, by the use of a level. When the ground-engaging section has been driven into the ground so that the hollow container section is above and generally level with the ground, then a post to be supported is placed within the confines of the fixed vertical wall section and the wedge elements are then inserted, for example short, right angled wedge end caps, with a 4"×4" square post, in an overlapping, sliding relationship with the respective folded hem edges of the vertical wall section edges. These tapered wedge edge caps are then tapped down alternately on each side generally to a flush top edge with the fixed wall section so that the folded edge within the folded edge of the vertical wall section forces the vertical wall section inwardly to pinch or wedge the post inside the hollow container section thereby providing secure vertical support for the post. Optionally, the wedge cap is secured by a nail driven at an angle through a hole in the corner of the wedge element into the post. The post support should have the space opening of the folded hem edge angled from top to bottom so that the wedge elements may be easily positioned and forced part way down before hammering for a pinching or wedging action occurs typically more than 25%–50% of the way down on the fixed wall sections.

The post support of the invention will be described for the purposes of illustration only in connection with certain embodiments, however, it is recognized that those persons skilled in art may make various changes, modifications, additions and improvements to the illustrated post support and method without departing the spirit and scope of the invention.

DESCRIPTION OF THE EMBODIMENTS

Figure 1:
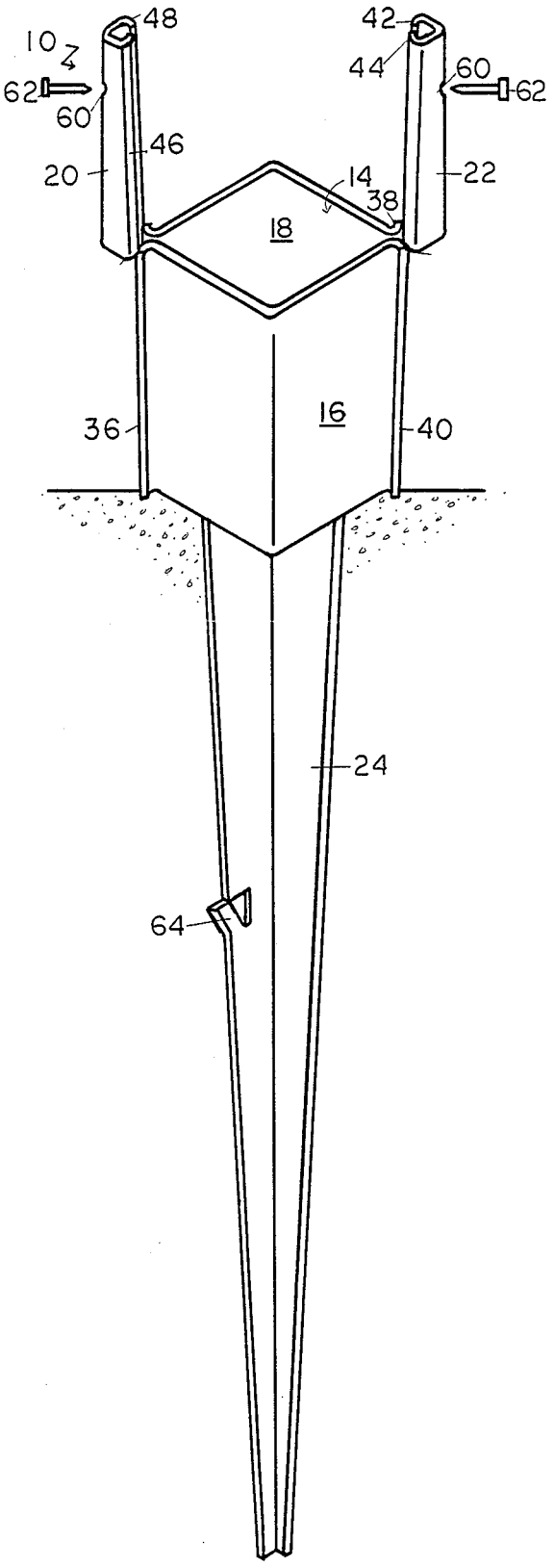
FIG. 1 is an illustrated, perspective, partially exploded view of the post support of the invention with a post in position to be secured.

FIGS. 1–5 illustrate a post support 10 to support a vertical 4"×4" wood post 12 in a hollow post box section 14 formed of fixed, right angled, metal, upright wall sections 16 and 18 with their outer vertical edges spaced apart at two corners. The post support includes separate metal wedge end caps 20 and 22. Wedge end caps 20 and 22 have tapered, 45° or less angled, hemmed edges 46 and 48, and 42 and 44 respectively which are adapted to fit in a slidable, snug, securing relationship with similarly tapered hemmed edges as illustrated of 34 and 38 of wall section 18 and 36 and 40 of wall section 16. The tapered edges are exaggerated in the drawing for the purposes of illustration. The wall section and wedge end caps may be formed by bending metal trapezoidal-shaped plates at right angles. For example, a suitable post support for a 4" by 4" post 10 is prepared by employing a 0.105" thick metal sheet with each of the vertical, right angled wall sections 16 and 18 formed from a trapezoidal sheet of $6\frac{7}{8}$" in height with a top width of 6 7/16" and a bottom width of $6\frac{7}{8}$" with a difference of 7/32" for each side for a taper of about 2.09°. The wedge end caps 20 and 22 are also formed from metal trapezoidal sheets of 6" in height with a top width of 2 7/16" and a bottom width of $2\frac{7}{8}$" with a 7/32" difference for each side. The trapezoidal sheets are bent as sections illustrated to form the respective walls and end caps.

The post support includes an elongated metal cruciform spike element 24 formed for example by welding together two right angled, bent, triangular metal pieces. The spike element 24 includes an upwardly projecting tab 64 bent at a 45° angle from the spike edge with another tab (not illustrated) on the opposite cruciform side and bent in an opposite direction.

FIG. 1 illustrates the wedge end caps 20 and 22 in position to be slide onto the tapered, hemmed edges of the wall sections 16 and 18 with the wedge end caps having a hole 10 in the upper corner for the driving of a nail 62 into the corner of the post 12 to be supported.

The post support (see FIGS. 3 and 4) has the cruciform spike 24 welded 30 to the wall sections 16 and 18 and includes a flat metal drive plate 26 secured by welds 30 to the top of the cruciform 24. The drive plate 26 is positioned so that the corners are on the cruciform sides for greater support.

Figure 2:
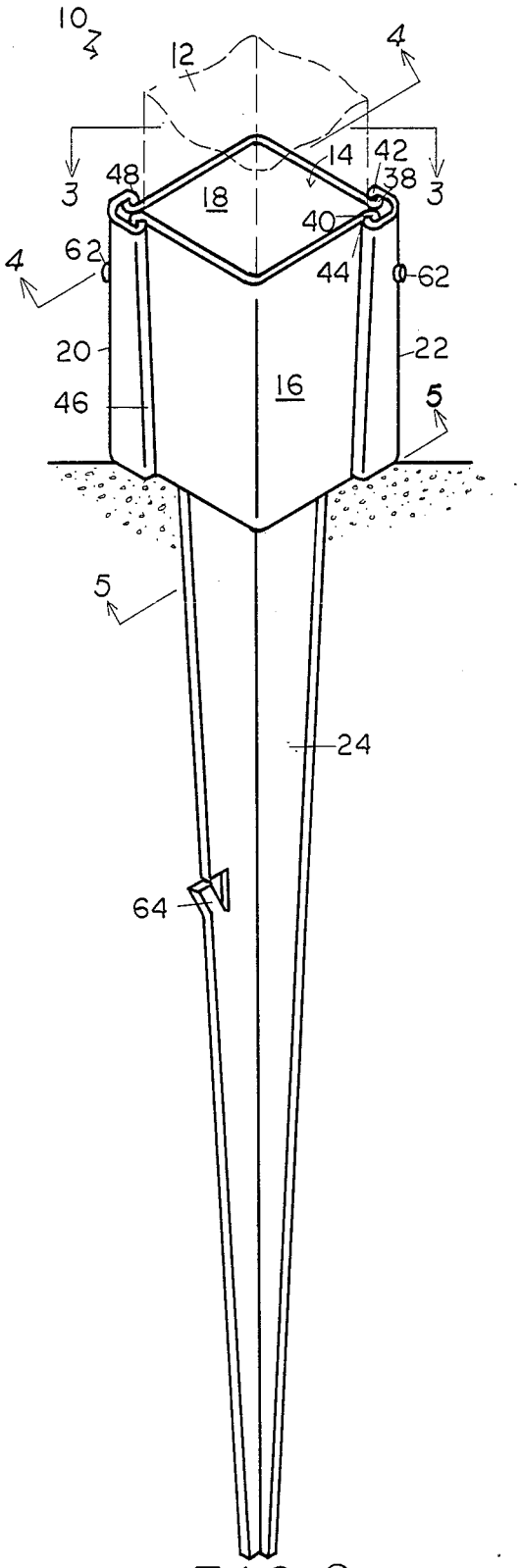
FIG. 2 is an illustrated, perspective view of the post support of FIG. 1 with the post supported and secured in position.
Figure 3:
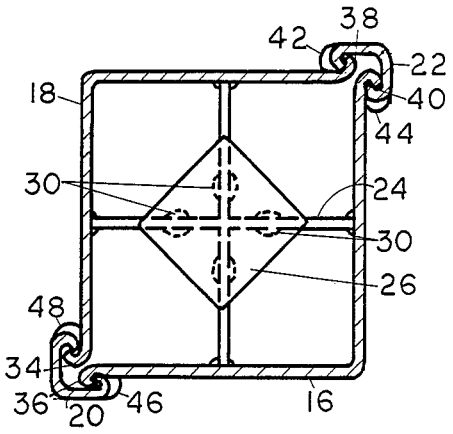
FIG. 3 is an enlarged top plan view of the post support of FIG. 2.
Figure 4:
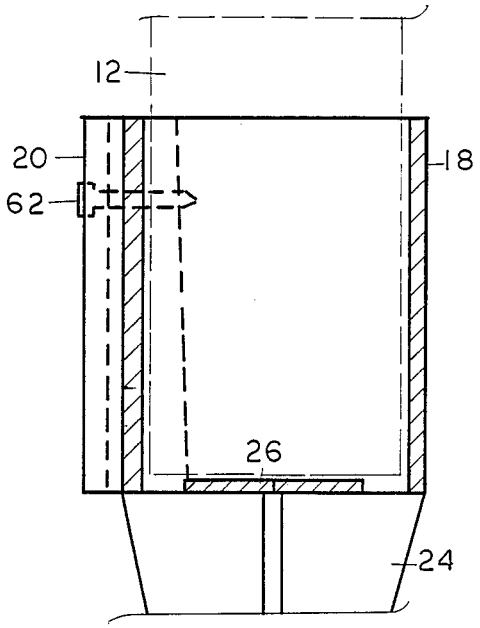
FIG. 4 is an enlarged side sectional view of the post support of FIG. 2 through line 4—4 of FIG. 2.
Figure 5:
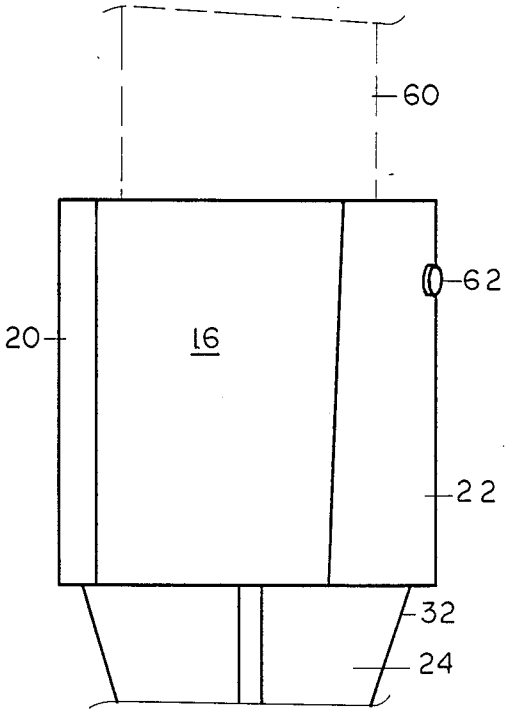
FIG. 5 is an enlarged side plan view of the post support of FIG. 2 along line 5—5 of FIG. 2.

FIG. 2 illustrates the post 12 supported in the post support 12 with the wedge end caps 20 and 22 hammered into position and secured by nail 62 in the post and with the fixed wall sections 16 and 18 forced into a wedging relationship about the post 12.

Figure 6:
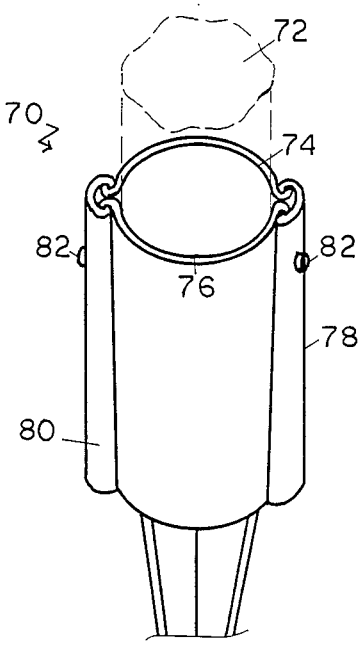
FIG. 6 is an illustrated, perspective view of another embodiment of a post support with a round post supported and secured in position.

FIG. 6 illustrates a post support 70 for use with a round post 72 in a found, hollow wall section formed of fixed wall sections 74 and 76 and arcuate wedges 78 and 80 secured by nails 82 in post 72. The wedges 78 and 80 and fixed walls 74 and 76 have tapered, hemmed edges as previously illustrated to force the wall sections 74 and 76 into a pinching relationship with the post 72.

The post support provides for the securing of a post in a secure and effective manner in an upright position.

What is claimed is:

1. A post support for securing a post in the ground in a generally upright, vertical position which post support comprises:

(a) an elongated, ground-engaging means to be driven vertically into the ground;

(b) a post support section means secured to the ground-engaging means and forming a hollow, post-receiving section to receive and support a post therein in a generally vertical position which includes at least one upright, vertical wall section having top and a pair of spaced apart, upright side edges and which form part of the hollow post receiving section;

(c) wedge means in a slidable, wedging relationship with the spaced apart side edge of the fixed wall section to force the outer sides of the fixed vertical wall sections inwardly into a wedging, securing relationship with the post within the hollow section; and (d) wherein the wedge means is characterized by a hole therein for the driving of a nail into the supported post to secure the wedge means in place.

2. The post support of claim 1 wherein (a) the post support section means comprises: a pair of generally upright, vertical, fixed wall sections to form a substantial part of the wall of the hollow post receiving section, each of said wall sections having a top edge and tapered side edges with edge folds, the side edges spaced apart from the sides edges of the other section; and (b) wherein the wedge means comprises: a pair of wedge caps each having a top edge and tapered side edges, each side edge having a tapered edge fold, adapted to fit in a snug slidable relationship with the edge folds of the said wall sections whereby the wedge caps on being driven downwardly force the said wall sections into a pinching, secure relationship with the post in the hollow section.

3. The post support of claim 1 which includes a drive plate means on top of the ground engaging means to permit a short post section to be used to drive the ground engaging means into the ground.

4. The post support of claim 2 wherein the fixed wall sections are right angled sections to form a rectangular hollow post receiving section, and the wedge means comprise right angled wedge end caps which complete the wall section and are adapted to be driven downwardly with the top edge of the wedge caps generally flush with the top edge of the said wall section when the post is in a secure position.

5. The post support of claim 2 wherein the said wall section and said wedge cap comprise arcuate sections to form a round hollow section to receive a round post.

6. The post support of claim 2 wherein the tapered folds are tapered at an angle of about 1° to 3°.

7. The post support of claim 1 which includes a post supported in the post receiving section and a nail through the nail hole in the wedge means to secure the wedge means in a pinching, secure position.

8. A post support for securing a post in the ground in a generally upright, vertical position which post support comprises:

(a) an elongated, ground-engaging means adapted to be driven vertically into the ground;

(b) a post support section means secured to and generally axially aligned with the ground-engaging means and forming at least one generally rectangular, hollow, post receiving section to receive and support the one end of a rectangular post therein in a generally vertical position which includes at least one upright, vertical wall having a top and a pair of spaced apart, upright side folded edges; and (c) angled wedge means having a generally V-shaped cross section for being placed in a slidable, wedging relationship with the spaced apart folded edges of the wall section to force the outer sides of the vertical wall sections inwardly into a wedging post securing relationship with the end of the post within the hollow section when the wedge means is driven generally vertically downwardly.

9. The post support of claim 8 wherein (a) the post support section means comprises: a pair of generally upright, vertical wall sections, each of said wall sections having side edges, the side edges spaced apart from the side edges of the other section and each side edge having a folded edge; and (b) wherein the wedge means comprises: a pair of angled wedge caps each having side edges, each side edge having an edge fold, adapted to fit in a snug, slidable relationship with the edge folds of the said wall sections whereby the wedge caps on being drive downwardly force the said wall sections into a pinching, secure relationship with the end of the post in the hollow section.

10. The post support of claim 8 wherein the ground-engaging means comprises an elongated cruciform element.

11. The post support of claim 8 wherein the ground-engaging means includes one or more outwardly projecting tab means on the elongated ground-engaging means to permit the ground-engaging means to be driven vertically into the ground, but which projecting tab means retard the vertical withdrawal of the ground-engaging means from the ground.

12. The post support of claim 8 which includes a drive plate means on top of the ground-engaging means to permit a short post section to be used to drive the ground-engaging means into the ground and to receive and retain the end surface of post to be supported in the post support section means.

13. The post support of claim 12 wherein the ground-engaging means comprises a cruciform element, and the drive plate means comprises a flat plate secured to the top of the sides of the cruciform with the plate edges within the post receiving section.

14. The post support of claim 8 wherein the wedge means are characterized by a hole therein for the driving of a nail into the supported post to secure the wedge means in place.

15. The post support of claim 9 wherein the fixed wall sections are right angled sections to form a square hollow post receiving section, and the wedge means comprises generally right angled wedge end caps which complete the wall section and are adapted to be driven downwardly with the top edge of the wedge caps generally flush with the top edge of said wall section when the post is in a secure position.

16. The post support of claim 9 wherein the spaced apart outer edges of the wall sections are slightly tapered from the top to the bottom of the wall edge sections so that the width of the edge opening at the bottom is slightly greater than the top.

17. The post support of claim 16 wherein the side edges are tapered from about 0.5 to 10 degrees from the vertical axis of the post support.

18. The post support of claim 9 wherein the post-receiving section and the wedge means include generally uniformly folded edges with the opening between the folded edges of the side walls of the section tapered.

19. The post support of claim 12 which includes a short section of a post section therein to permit the post section to be hammered to drive the ground-engaging means into the ground.

20. A supported post which comprises the post support of claim 8 with a supported post wedgingly secured in the post support section means and the ground-engaging means vertically driven into the ground.

21. The post support of claim 8 which includes:

(a) a post secured in the post support section, each wall section having a top and bottom edge and side edges, the side edges of each wall section spaced apart from the opposing side to form a slightly tapered opening between the opposing side edges, the wall sections forming a substantial part of the peripheral wall of the hollow section, the side edge slightly tapered from the top edge to the bottom edge; and (b) a pair of wedge means which comprise wedge end cap elements each having a top and bottom edge and side folded edges, the side edges adapted to fit in a slidable, snug relationship with the folds of the wall sections so that when the wedge end caps are slidably positioned and driven downwardly, the wedge end cap elements force the sides of the said wall sections into a secure, wedging relationship with a post in the hollow post receiving section.

22. A post support for securing a post in the ground in a generally vertical, upright position which post support comprises:

(a) an elongated cruciform, ground-engaging element adapted to be driven generally vertically into the ground;

(b) a flat drive plate element secured to the top of the cruciform ground-engaging element to permit the use of a short section of the post to drive the ground-engaging element into the ground;

(c) a pair of upright, vertical wall sections each having side edges with edge folds, the opposing side edges spaced apart a slight distance, the wall sections forming a square, hollow, post-receiving section to receive the end of a square post to be supported; and (d) a pair of generally right angled wedge end caps each having folded edges and adapted to fit in a slidable, wedging relationship with the edge fold of the wall sections so that when the wedge end caps are driven downwardly, the side of the pair of wall sections are forced inwardly into a post securing relationship with the end of the post.

23. A post support for securing a round post in the ground in a generally upright, vertical position, which post support comprises:

(a) an elongated, ground-engaging means adapted to be driven vertically into the ground;

(b) a post support section means secured to and generally axially aligned with the ground-engaging means and forming at least one generally round, hollow, post-receiving section to receive and support the one end of a round post therein in a generally vertical position which includes at least one upright, vertical wall having a top and a pair of spaced apart, upright side folded edges, the space between the folded edges slightly tapered from the top to the bottom of the wall section so that the width of the space at the bottom is slightly greater than at the top; and (c) angled wedge means having folded edges to form an angular wedge cap and adapted to be placed in a slidable, wedging relationship with the spaced apart folded edges of the wall section to force the outer sides of the vertical wall sections inwardly into a wedging, post-securing relationship with the end of the post within the hollow section when the wedge means is driven generally vertically downward.

24. The post support of claim 23 wherein the edge folds of the section and wedge means are generally uniform in width.

* * * * *